United States Patent [19]

Glenn et al.

[11] Patent Number: 4,595,232

[45] Date of Patent: Jun. 17, 1986

[54] PORTABLE CHAIR THAT CAN BE FOLDED INTO A COMPACT CARRYING UNIT

[75] Inventors: Holt E. Glenn, P.O. Box 497, Ayden, N.C. 28513; Clarence F. Smith, Jr., Ayden, N.C.

[73] Assignee: Holt E. Glenn, Ayden, N.C.

[21] Appl. No.: 672,915

[22] Filed: Nov. 19, 1984

[51] Int. Cl.[4] ..... A47C 4/28

[52] U.S. Cl. ..... 297/17; 297/45; 297/51; 5/112

[58] Field of Search ..... 297/17, 51, 52, 45, 297/56, 350, 352, 440; 5/110, 112, 113, 114, 116

[56] References Cited

U.S. PATENT DOCUMENTS

| | | | |
|---|---|---|---|
| 266,092 | 3/1880 | McCullough | 297/45 X |
| 1,608,924 | 11/1926 | Brown | 5/116 X |
| 1,721,366 | 7/1929 | Backstrom | 297/350 |
| 1,885,269 | 11/1932 | Kraner | 247/51 |
| 2,591,551 | 4/1952 | Kaplan | 5/110 |
| 2,711,787 | 6/1955 | Hallowell, Jr. et al. | 297/440 X |
| 3,749,192 | 7/1973 | Karchak, Jr. et al. | 297/DIG. 4 X |
| 3,937,519 | 2/1976 | Schoolden | 297/352 X |
| 4,032,189 | 6/1977 | Benavente et al. | 297/352 |
| 4,285,542 | 8/1981 | Boisvert | 297/451 X |
| 4,369,987 | 1/1983 | Witherell | 297/45 X |

FOREIGN PATENT DOCUMENTS

| | | | |
|---|---|---|---|
| 781373 | 5/1935 | France | 5/112 |

*Primary Examiner*—William E. Lyddane
*Assistant Examiner*—José V. Chen
*Attorney, Agent, or Firm*—Fred Philpitt

[57] ABSTRACT

A portable chair that includes seat support members that can be folded together, a pair of X-configured leg sections pivotally connected to the seat support members, the pivotal connections permitting change of the leg sections from a person support function to a folded up condition wherein the leg members move through an angle of 270° so as to lie in adjacent parallel planes with each other and with the folded together seat support members.

1 Claim, 9 Drawing Figures

PORTABLE CHAIR THAT CAN BE FOLDED INTO A COMPACT CARRYING UNIT

Our invention pertains to a chair which is constructed so that after use it can be partially disassembled and folded into a compact bundle so that it can be readily carried from place to place and/or stored in a small space.

A preferred embodiment of our chair is illustrated in the drawings wherein:

FIG. 5 is a view of the embodiment of FIG. 1 with one leg section opened out and one leg section still folded in;

Figure 1:
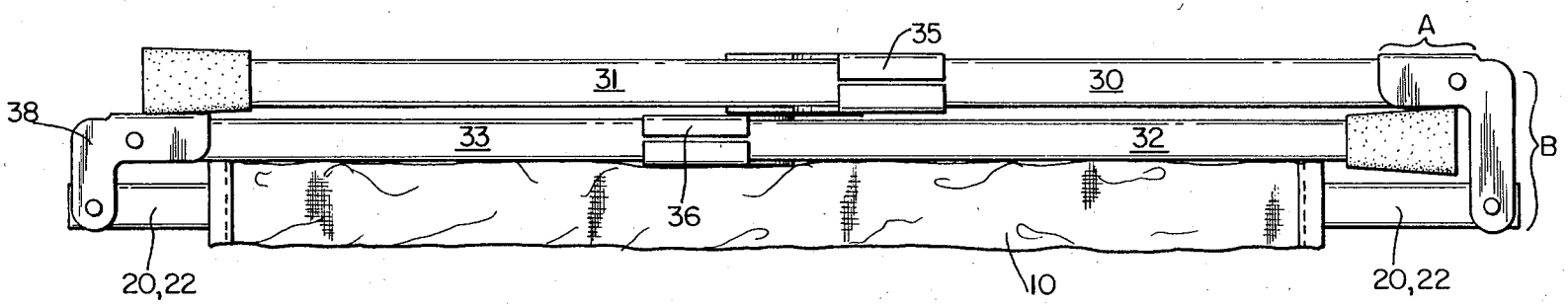
FIG. 1 is a side view of the seat portion of our chair in its folded carrying position.
Figure 2:
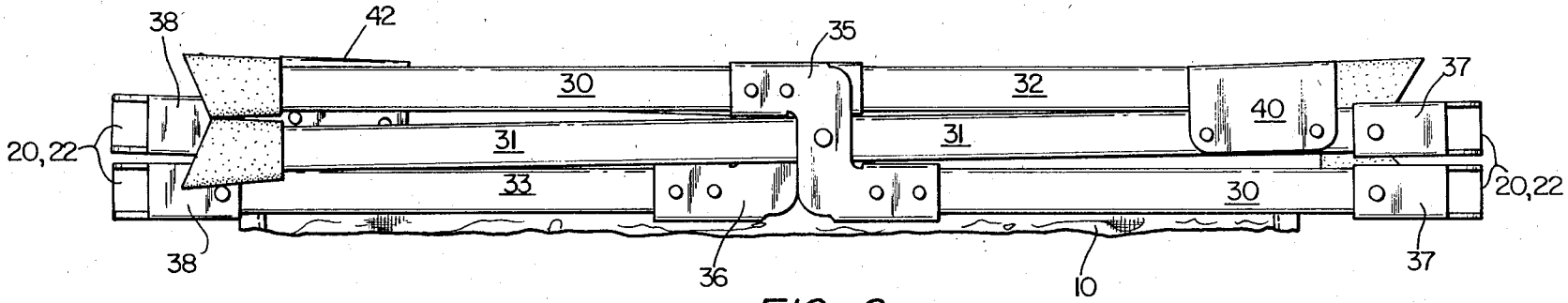
FIG. 2 is a top view of FIG. 1.
Figure 3:
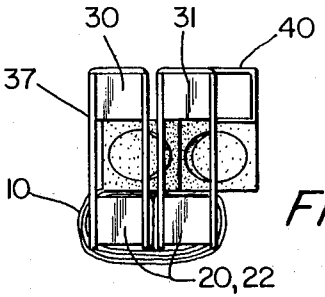
FIG. 3 is a view of the right end of FIG. 1.
Figure 4:
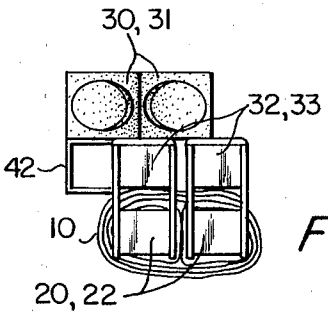
FIG. 4 is a view of the left end of FIG. 1.

Referring now to the drawings it will be seen that our portable chair first of all contains a generally rectangular seat 10 composed of strong and flexible sheet material that is disposed in a generally horizontal plane and which has a front edge, a rear edge, and two side edges. The sheet material is preferably canvas or heavy cloth made of natural or synthetic material and which is strong enough to support a seated person when in the position shown in FIGS. 7–9. The sheet material 10 must be flexible enough so that it can readily be folded into a compact bundle as indicated in FIGS. 1–5.

Figure 7:
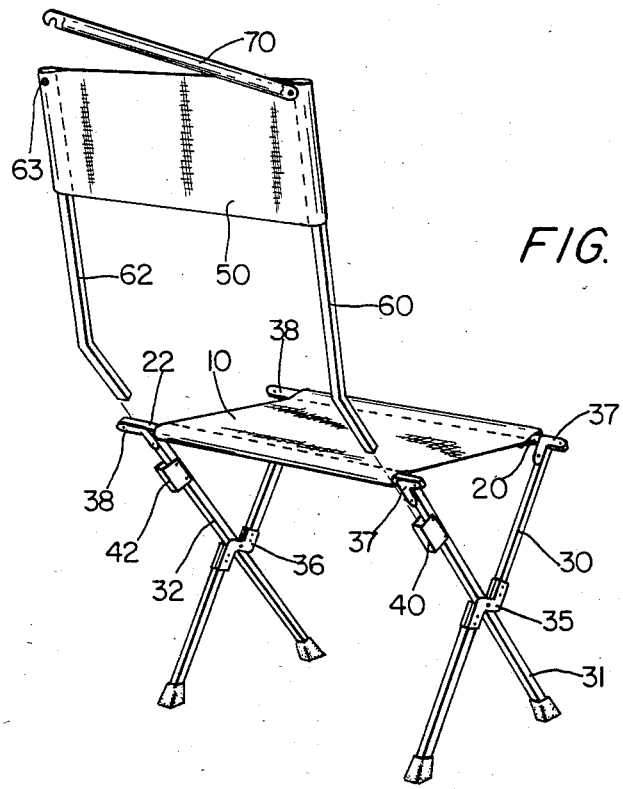
FIG. 7 shows the seat section fully opened and ready to receive a back section.
Figure 8:
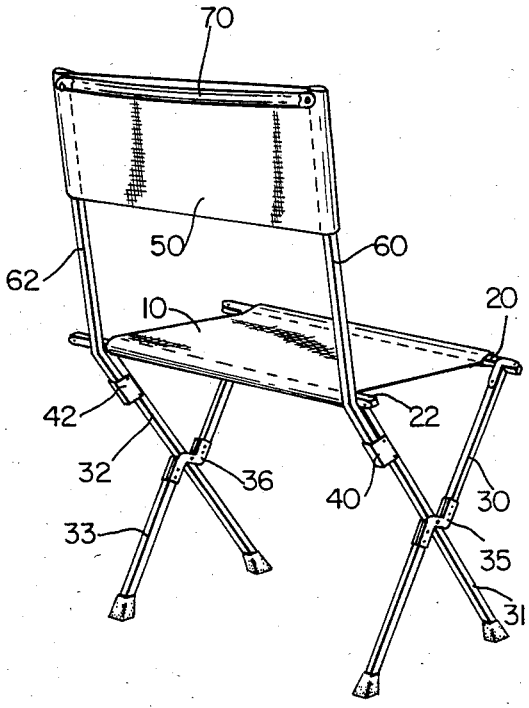
FIG. 8 is the same as FIG. 7 with the back section in place.
Figure 9:
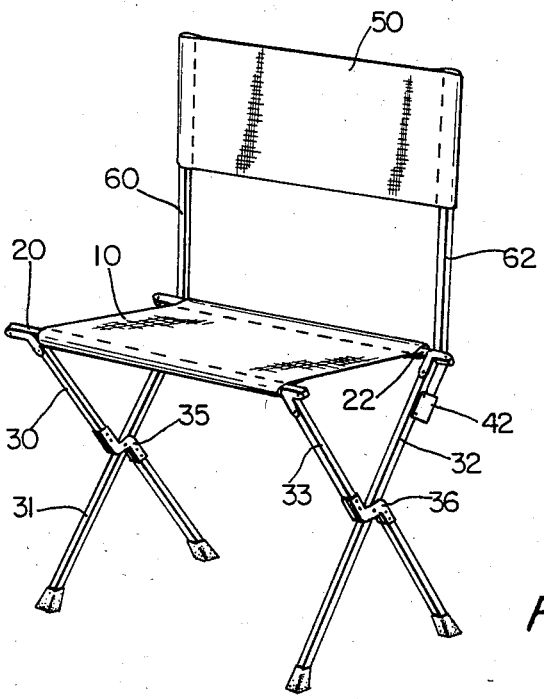
FIG. 9 is a front view of the chair shown in FIG. 8.

The rectangular seat means 10 is supported by a spaced apart pair of elongated seat support members 20 and 22 that engage the front edge and rear edge of the seat means 10. These support members 20 and 22 serve to support the seat means 10 in a generally horizontal plane when the chair is in its operative position, as is shown in FIGS. 7–9. As shown the seat support members 20 and 22 each pass through an overturned "loop" on the front and rear edges of seat means 10, but the seat means 10 could also be riveted, adhesively secured, or otherwise fastened to the support members 20 and 22.

Figure 5:
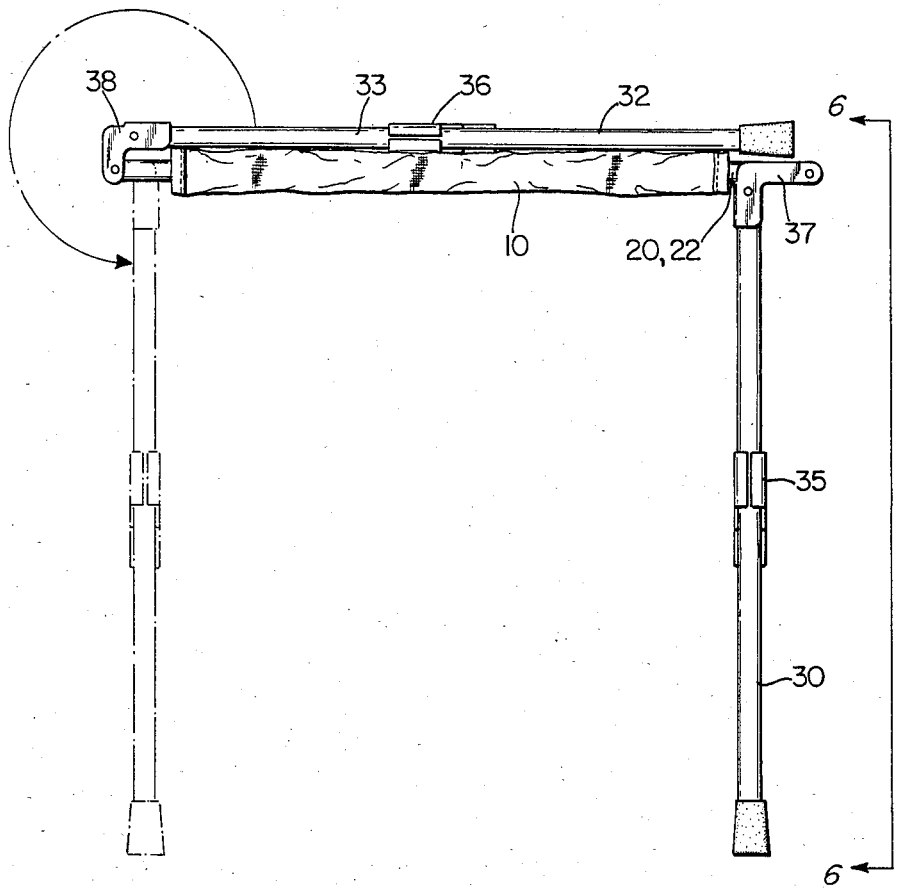
Figure 6:
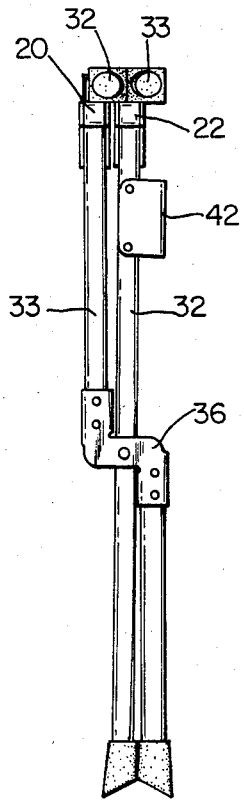
FIG. 6 is a view from 6—6 of FIG. 5.

The outer ends of the seat support members 20, 22 are attached to a pair of X-configured leg sections. Each X-configured leg section consists of two elongated leg members that are pivotally connected to each other intermediate there ends so that the leg members can be pivoted apart in the configuration of an "X" or pivoted together in a configuration resembling an "I". For instance, in the drawings the two elongated leg members 30 and 31 are connected together by pivotal connection means 35, and elongated leg members 32 and 33 are connected together by pivotal connection means 36. The upper end of each of the leg members 30, 31, 32, 33 is pivotally connected to the outer end of one of the seat support members 20, 22 by an L-shaped pivotal connection means 37, 38. Each L-shaped pivotal connection means 37, 38 has one pivot leg that essentially follows the line of the leg member to which it is attached while the other pivot leg of each L-shaped pivotal connection means is essentially perpindicular to said first pivot leg. This can be illustrated with specific reference to FIG. 1, section "A" of L-shaped pivotal connection means 37 essentially follows the line of the leg 30 to which it is attached, while the section portion "B" of L-shaped pivotal connection means 37 is essentially perpindicular to said section "A". Also, as is perhaps best seen in FIG. 1, it is preferable that one of the L-shaped pivotal connection means be larger than the other insofar as section "B" is concerned. It is thus noted in FIG. 1 that L-shaped pivotal connection means 37 is not the same size as L-shaped pivotal connection means 38, and these sizes are not the same so that when the leg members 30, 31, 32, 33 are folded together as shown in FIG. 6, and then through an arc of 270° as shown in FIG. 5 to a compact storage position, the leg members will nest closely together in a compact relationship. One end of each L-shaped connection member 37, 38 is attached by riveting or other fastening means to one end of a seat support member 20, 22. This is also perhaps best seen in FIGS. 1–5.

It will be noted from the drawings that each pair of X-configured leg sections consists of one long essentially straight member (see 31 and 32) whereas the other leg member 30, 33 consists of two portions that are not aligned with each other and which are connected together by the pivot means 35–36. This arrangement facilitates compact folding and storage. FIGS. 7–9 show the leg members in their spread apart seat supporting position, whereas FIG. 6 shows the leg members brought together in the compressed position that they will assume during storage.

The back leg member 31, 32 of each pair of X-configured leg sections is provided with a supporting socket 40, 42. Each socket is adapted to receive an elongated post member 60, 62. A generally rectangular back support means 50 composed of strong and flexible sheet material is supported in a generally vertical plane between posts 60 and 62. The sheet material 50 has a top edge, a bottom edge and two side edges, the two side edges preferably being sewn over in the form of loops that surround the posts 60, 62.

FIGS. 7 and 8 show that a spacer bar 70 can be used to hold the posts 62 and 60 a fixed distance apart and this spacer bar 70 can simply consist of an elongated rod having one end pivotally connected to post 60 (e.g. by a rivet) and the other end pivotable through an arc and having a hook at its end which can engage a button, knob or other protrusion 63 on post 62. Bar 70 can be pivoted until it is parallel to post 60 and then posts 60, 62 as well as bar 70 and back support means can be formed into a compact bundle that isn't much larger than the two posts 60 and 62.

After the chair shown in FIGS. 8 and 9 has been used and the user desires to move it to another location, the following sequence is followed:

(a) the spacer bar 70 is disengaged from 63 and folded parallel to post 60, (b) the posts 60 and 62 are removed from sockets 40 and 42 and bundled into side-by-side position, (c) the X-configured leg sections are collapsed toward each other as is indicated in FIG. 6, (d) the collapsed leg sections are each pivoted through an arc of about 270°, as shown in FIG. 5, until the compact arrangement shown in FIGS. 1–4 is achieved, and (e) the bundle shown in FIGS. 1–4 is then combined with the bundle resulting from step (b) and the two bundles placed in a suitable carrying case.

Although we have described a preferred embodiment of our invention, our invention is not limited to the specific details shown and is instead only limited by the scope of the following claims.

We claim:

1. A portable chair comprising in combination (a) a generally rectangular seat means composed of strong and flexible sheet material that is disposed in a generally horizontal plane, and which has a front edge, a rear edge and two side edges, (b) a spaced apart pair of elongated seat support members that engage the front edge and the rear edge of said rectangular seat means and which can serve to support said seat means in a generally horizontal plane when the chair is in its operative position, (c) a pair of X-configured leg sections attached to the ends of said seat support members, each X-configured leg section (1) consists of two elongated leg members that are pivotally connected to each other intermediate their ends so that the leg members can be pivoted apart in the configuration of an "X" or pivoted together into a configuration resembling an "I", (2) having the upper ends of each leg member pivotally connected to a lateral end of a seat support member by an L-shaped pivotal connection means, each said L-shaped pivotal connection means having one pivot leg that essentially follows the line of the leg member to which it is attached and another pivot leg that is essentially perpindicular to said first pivot leg and extending outwardly therefrom, each said L-shaped pivotal connection means being pivotally connected to the sides of an end of an elongated seat support member at a point which is outwardly from the point at which said L-shaped pivot connection means is connected to said elongated leg members so that when the pairs of the elongated leg members are each pivoted together into said configuration resembling an "I", the thus I-configured pairs can be further pivoted through an angle of 270° until all of the leg members are parallel to each other and also parallel to said pair of elongated seat support members, the legs of one pair of L-shaped pivotal connection means being longer than the corresponding legs on the other pair of L-shaped pivotal connection means so that when the portable chair is in its "folded up" condition, the pairs of folded up legs will lie in immediately adjacent planes that are parallel to each other and also parallel to the immediately adjacent folded together seat support members, figured leg sections (d) the back leg member of each pair of X-configured leg sections being provided with a receiving and supporting sockets, (e) a generally rectangular back support means composed of strong and flexible sheet material that is disposed in a generally vertical plane and which has a top edge, a bottom edge and two side edges, (f) a spaced apart pair of elongated post members that engage the side edges of said back support means and which serve to support said back support means in a generally vertical plane when the chair is in its operative position, the lower ends of said post members being supported by the sockets set forth in (d).

* * * * *